United States Patent [19]

Bozzay et al.

[11] 4,096,408

[45] Jun. 20, 1978

[54] UNITIZED IN-LINE ELECTRON GUN HAVING STRESS-ABSORBING ELECTRODE SUPPORTS

[75] Inventors: Lajos T. Bozzay, Chicago; Norman F. Gioia, Lombard, both of Ill.

[73] Assignee: Zenith Radio Corporation, Glenview, Ill.

[21] Appl. No.: 653,050

[22] Filed: Jan. 28, 1976

[51] Int. Cl.[2] ..... H01J 29/02; H01J 29/46; H01J 29/82

[52] U.S. Cl. ..... 313/417; 313/457

[58] Field of Search ..... 313/417, 457, 409, 411, 313/456, 451, 414

[56] References Cited

U.S. PATENT DOCUMENTS

| | | | |
|---|---|---|---|
| 2,810,851 | 10/1957 | Johnson | 313/456 |
| 2,859,378 | 11/1958 | Gundert et al. | 313/409 X |
| 2,897,391 | 7/1959 | Erskine | 313/456 |
| 2,950,406 | 8/1960 | Barnett et al. | 313/411 |
| 3,119,035 | 1/1964 | Atti et al. | 313/451 |
| 3,575,626 | 4/1971 | Blumenberg | 313/417 |
| 3,772,558 | 11/1973 | Nagao | 313/456 X |
| 3,816,789 | 6/1974 | Sawagata et al. | 313/417 X |

*Primary Examiner*—Robert Segal
*Attorney, Agent, or Firm*—Ralph E. Clarke

[57] ABSTRACT

This disclosure depicts and describes a unitized, in-line electron gun for television cathode ray tubes having a bead-type structure for mechanically supporting, spacing, aligning and electrically isolating gun components. This disclosure is particularly directed to an improved system of electrode support that absorbs stress induced during the mounting process to leave the gun structure substantially free of residual stress, thus reducing the incidence of bead fracture and electrode displacement.

6 Claims, 10 Drawing Figures

UNITIZED IN-LINE ELECTRON GUN HAVING STRESS-ABSORBING ELECTRODE SUPPORTS

CROSS-REFERENCE TO RELATED APPLICATIONS

This application is related to but in no way dependent upon copending applications of common ownership herewith, including Ser. No. 655,592, filed Feb. 6, 1976; Ser. No. 494,123, filed Aug. 2, 1974; Ser. No. 668,858, filed Mar. 15, 1976; Ser. No. 649,630, filed Jan. 16, 1976; and Ser. No. 642,049, filed Dec. 18, 1975.

BACKGROUND OF THE INVENTION

This invention relates generally to improved, unitized in-line electron guns for color cathode ray tubes, and more specifically, to an improved gun electrode support structure that resolves main problems in gun assembly by reducing the incidence of fracture of the supporting beads, and by alleviating forces that can cause electrode displacement.

Unitized in-line electron guns generate three coplanar electron beams developed by thermionic emission of cathodes arranged in line. The resulting beams are formed and focused by a tandem succession of electrodes spaced along the central axis of the gun. The electrodes cause the beams to converge at multiple phosphor groups located on the faceplate of the color cathode ray tube. The prime objective of the design of such guns is to provide small spot size and enhanced resolution. To accomplish this objective, the electron gun electrodes and their field forming surfaces should be accurately spaced, the opposing faces of the electrodes should be parallel, and the beam passageways that extend from the point of beam origin at the cathodes in the base area of the gun and through to the convergence cup at the opposite end, should be coaxially aligned.

A standard production assembly procedure for such electron guns consists of the process of holding the discrete parts of the gun rigidly in proper relationship to each other by means of mechanical fixtures, then fastening all parts together by pressing an elongated heat-softened bead of glass onto support tabs or "claws" that project from the gun parts. These structural beads, also called "pillars" or "multiform beads", are typically made of glass of special composition and characteristics. Two elongated beads are normally used on unitized, in-line guns, one on each side of the succession of electrodes and extending in a direction parallel to the axis of the gun. Upon cooling of the beads and removal of the gun structure from the fixture, the gun parts are more or less permanently affixed in proper spatial relationship to each other, depending upon the stability and mechanical integrity of the bead-tab structure. The function of the beads is to provide mechanical support; retain proper positioning, spacing and coaxial alignment; and allow electrical isolation of the electrodes.

Production experience has shown this method to be less than ideal as evidenced by the many rejections of gun assemblies during manufacture because of fracture of the supporting beads upon cooling, or fracture during the high-voltage conditioning process. If such fractures do occur, the entire gun must be discarded even though it has reached the final stage of production and has accrued nearly all of its production cost. And there is another defect in this system that may occur: even if catastrophic fracture does not take place, the parts of the gun cannot be relied upon to remain permanently in proper spatial relationship or alignment because of the stresses that may have been built in by the beading may tilt or otherwise displace the electrodes, resulting in degeneration of gun performance.

The problems set forth are well known to practitioners in the field, and their solution seems to be a common one. The following prior art patents showing single-member electrode support systems seek to provide support for the electrode by making the individual electrode support members rigid: U.S. Pat. Nos. 2,788,966; 3,239,708; 2,950,406; 3,543,071; 3,701,920 and 3,614,502.

In U.S. Pat. No. 3,389,284, Andrews recites an electrode support structure for a delta-configured, three-gun color cathode ray tube in which the electrodes are supported by welded-on straps, the claw ends of which are embedded in three elongated glass beads. The claws have centrally located offset tines which deflect during a welding process to form an electrical contact with adjacent tines. So that they may deflect and yield easily without unduly stressing the grids or weakened support straps during the welding process, the tines are seakened at the point where they emerge from the straps. The weakened tines have no direct electrode support function.

OBJECTS OF THE INVENTION

It is a general object of this invention to provide an improved electrode support structure for unitized, in-line electron guns for color cathode ray tubes that enhances the structural integrity of such guns.

It is a less general object of this invention to provide a stress-absorbing electrode support structure that reduces the incidence of fracture of the structural glass beads.

It is another object of this invention to provide a stress-absorbing electrode support structure that reduces the tendency toward electrode displacement that may result from the beading process.

BRIEF DESCRIPTION OF THE DRAWINGS

The features of the invention which are believed to be novel are set forth with particularity in the appended claims. The invention, together with objects and advantages thereof may be best understood, however, by reference to the following description taken in conjunction with the accompanying drawings, in which the several figures of which like reference numerals identify like elements and in which:

DESCRIPTION OF THE PREFERRED EMBODIMENT

Unitized types of electron guns offer many advantages over other types in common use for color cathode ray tubes such as the delta-cluster gun. Advantages include the fact that the gun has fewer parts and the "unitizing" of the control grid and accelerating grid results in fewer connections and circuits.

Figure 1:
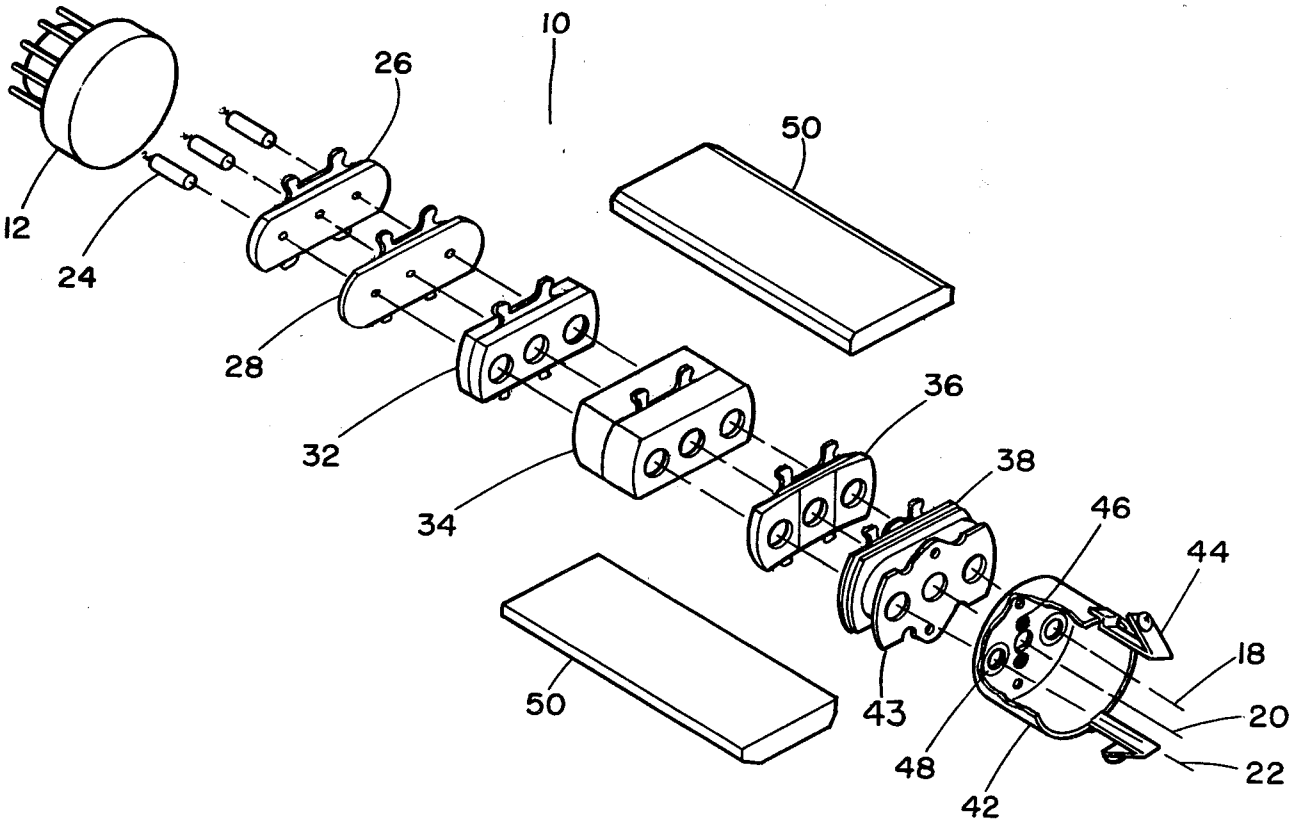
FIG. 1 is an exploded view in perspective of the elements of a color cathode ray tube unitized, in-line gun constructed and structurally supported in accordance with this invention.
Figure 2:
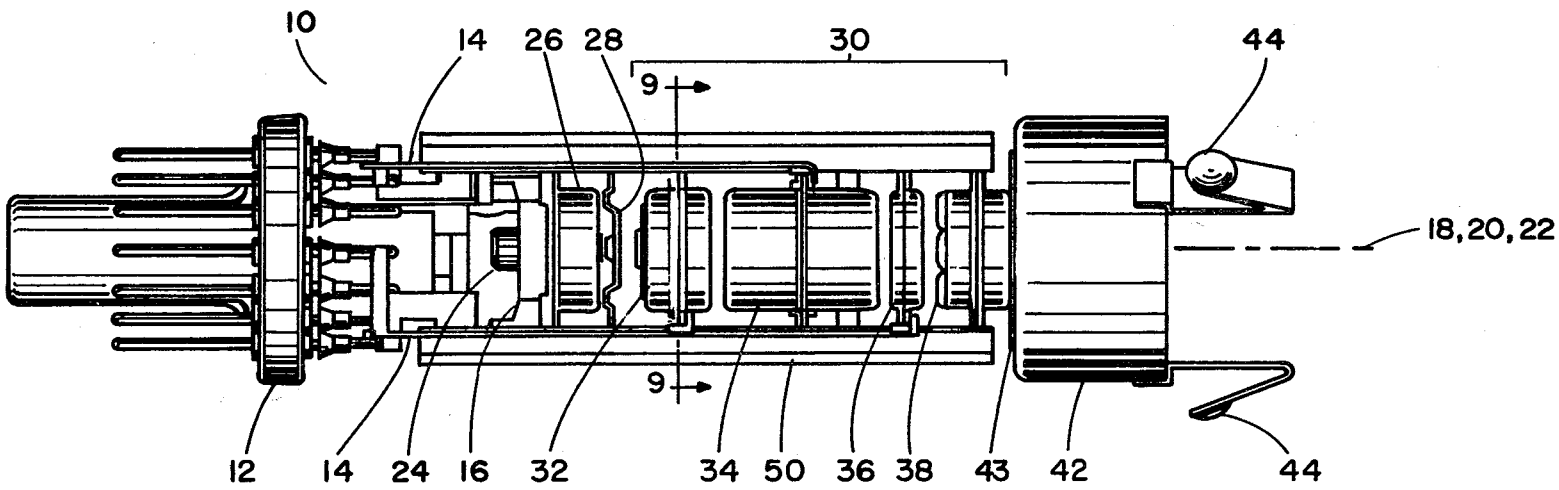
FIG. 2 is an assembled side view of the gun shown in FIG. 1.

Whereas the invention can be embodied in electrode structures of several different types, a preferred embodiment of the principles of this invention is illustrated in FIGS. 1-9. FIG. 1 is an exploded view in perspective of a unitized electron gun for use in a color television cathode ray tube which incorporates the present invention, and FIG. 2 is an assembled side view of the FIG. 1 gun. The electron gun structure for a cathode ray tube is located at the base of the tube in the narrow neck region opposite the faceplate. The illustrated embodiment shows a unitized, in-line type of gun that generates three coplanar electron beams, each of which is formed, shaped and directed to energize phosphor elements located on the imaging screen in the expanded area at the opposite end of the glass cathode ray tube envelope.

Referring to FIGS. 1 and 2, a cathode ray tube base 12 provides a plurality of electrical leads for introducing into the glass envelope the video and blanking signals as well as certain voltages for beam forming and focusing. The operating signals and voltages are conveyed to the electrodes of gun 10 within the envelope by means of internal electrical leads, two typical ones of which are shown by 14. The three electron-emitting cathodes 24 of the heater-cathode assembly 16 generate three coplanar beams of electrons 18, 20 and 22 which travel through a series of electrodes to energize the red, green and blue phosphors on the imaging surface of the television cathode ray tube through a multi-apertured color selection electrode (not shown). A unitized, disc-type accelerating grid 28 follows control grid 26 in the progression of the three electron beams from the cathodes 24 to the imaging screen. The three beams enter the electrostatic fields of the main focusing lens 30, consisting of unitized electrodes 32, 34, 36 and 38 constructed according to this invention. Each electrode in lens 30 carries a predetermined voltage to establish a beam focusing field, or an "electrostatic lens" for each beam. This type of lens, also referred to as an "extended field lens", utilizes the principles of the extended field lens described and claimed in U.S. Pat. No. 3,895,253 by Schwartz et al. Each electrode 32, 34, 36 and 38 is electrically isolated from the others to establish the focusing fields of the electron lens which they comprise, and each contain three electrically shielding beam-passing tubes therethrough formed from the electrode material. The beam-passing tube concept does not constitute, per se, an aspect of this invention, but is described and claimed in copending application Ser. No. 655,592 filed Feb. 6, 1976.

The difference in potential between ajacent focusing electrodes 32, 34, 36 and 38 establishes a series of focusing field components capable of shaping a beam of electrons flowing through the field components, according to the principles of electron optics. In the unitized, in-line gun that is the subject of this disclosure, the potentials between electrodes 32, 34, 36 and 38 may, for example, have an axial potential distribution which varies monotonically from a relatively intermediate potential at electrode 32, to a relatively low poential at electrode 34, and varies again monotonically to a relatively intermediate potential on electrode 36, to a relatively high potential at electrode 38. This axial potential distribution is the subject of the referent copending application Ser. No. 494,123 filed Aug. 2, 1974.

Further shaping, directing and focusing of the electron beams is accomplished between electrodes 36 and 38, the configuration of which constitutes two separate electron lens components for converging the outer two beams 18 and 22 inwardly to a common point of combination with center beam 20, which does not vary from a direct axial path. The convergence of beams 18 and 22 towards center beam 20 is accomplished by a slight inward bias shape of the two electrode faces of the two outer beam apertures of electrode 36, and a parallel, matching bias shape on the facing members of electrode 38. The bias-shaped electrode concept does not constitute, per se, an aspect of this invention but is described and claimed in copending application Ser. No. 668,858 filed Mar. 15, 1976.

The last in the series of elements that comprise electron gun 10 is the convergence cup 42, which provides a mounting base for the three contact springs 44 which in turn hold the forward end of the gun firmly centered in the neck of the cathode ray tube. Also, through contact with the electrically conductive coating on the inside of the neck of the tube, contact springs 44 convey the high voltage potential through convergence cup 42 to electrode 38. Located within the cup formed by the convergence cup, and adjacent to the apertures from which the three electron beams 18, 20 and 22 emerge are magnetic enhancers 46 and shunt magnets 48. Convergence cup 42 is aligned and bonded to electrode 38 in precise registration by means of a carrier plate 43, which lies between the two elements. The carrier plate and its associated assembly method does not constitute, per se, an aspect of this invention, but is described and claimed in copending application Ser. No. 649,630 filed Jan. 16, 1976.

The foregoing description provides general background for the understanding of the invention and the objects thereof. In the following, the preferred embodiments of the improved gun electrode support structure are described in detail.

The problems which this invention resolves have their origin in the standard production assembly procedure for electron guns which involves fixturing the gun components in precise inter-relationship, and pressing elongated, heat-softened beads of glass onto the support tabs that extend from the electrodes. Upon cooling of the beads and removal of the gun from the fixture, the gun parts are more or less permanently affixed in proper spatial relationship to each other. But this system is less than perfect as shown by the fact that fracture can occur in the glass of the beads, making it necessary to discard the gun; or, stresses built into the structure by the beading process may cause the electrodes to displace beyond dimensional tolerance limits, resulting in a degradation of gun performance.

With regard to bead fracture, the primary cause lies in the stress concentrations set up at the several regions of embedment of the electrode support tabs during the beading process. Such stress concentrations are the result of differences in the coefficients of expansion of the glass bead and the metal of the support tabs. The ratio of expansion of metal-to-glass is approximately six to one. During the beading process, as the beads, heated to a plastic consistency, engulf the metal of the tabs in the regions of embedment, the metal takes up heat rapidly and begins to expand. At the same time, the glass begins to cool, and to shrink as it sets up. The result is an "overshoot" condition wherein the differing rates of heating and cooling of the glass and the metal, and the differing amounts of expansion and shrinkage of the two materials set up concentrations of stress in the regions of embedment. The resulting stress is exerted upon both the metal and the glass in varying degrees.

With regard to stress on the glass, if the electrode support structure is rigid, and the electrode in turn is held rigidly by the assembly holding fixture, any asymmetrical aspect will result in a substantial moment of torque in the region of embedment of the electrode support tab, with consequent stress on the glass that can result in fracture. This "locked-in" moment of torque also may be aggravated by any differential in the rate of cooling in the glass that may occur in parallel planes on either side of region of embedment, causing the support to rotate and lock in stress.

Another problem may exacerbate the condition: while glass may have a tensile strength of 2000 psi (14.6 kg/cm$^2$) under static conditions, under dynamic conditions such as that exerted by the continuous heating and cooling of the electron gun during operation, the tensile strength of the glass at the region of embedment may fall to as low as 200 psi (14.06 kg/cm$^2$). The result can be fracture of the bead at some point of future time in the operating life of the gun.

Such stress concentrations can exert an undesirable influence upon the electrodes as well. As the glass sets up upon cooling, since some form and positional asymmetry always exists within practical manufacturing tolerances, a moment will be induced that can tip or otherwise displace the electrode in relation to the opposed adjacent electrodes to the extent that out-of-tolerance conditions may be established with regard to spacing, parallelism, or coaxial alignment.

Figure 3:
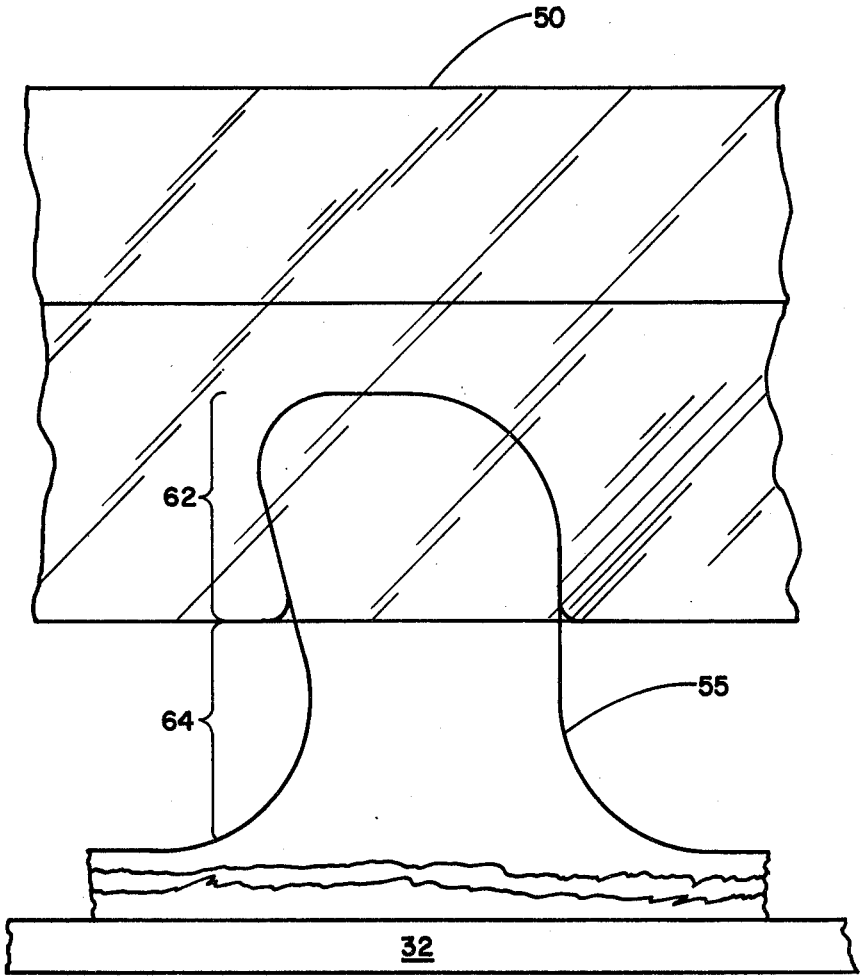
FIG. 3 is a side view in perspective showing the configuration of an electrode support tab constructed according to this invention and in relation to a supporting bead, which is shown in section.
Figure 4:
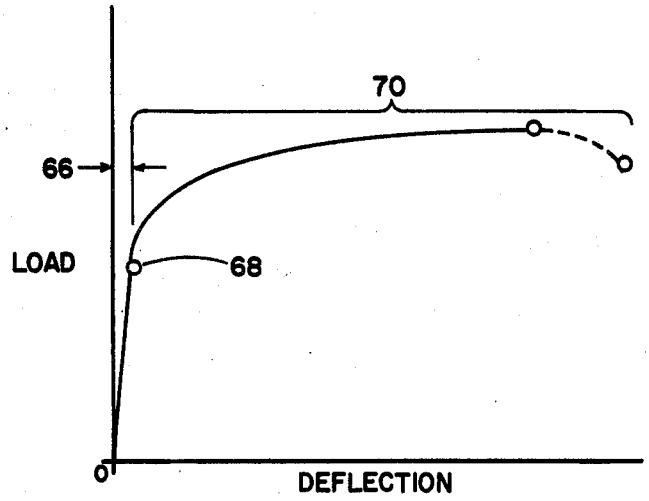
FIG. 4 is a curve that indicates the desired yield point of the material of the electrode support tab.

The solutions to the problems of bead cracking and electrode displacement that result from the beading process lie in localizing the residual stress in the electrode support tab and absorbing it in the tab. An electrode support tab designed to absorb stress is shown by FIG. 3, and represents a preferred embodiment of an aspect of this invention. The electrode 32 from which this tab extends (referring to FIGS. 1 and 2) is the first electrode in the series comprising electron lens 30, and its electrode support configuration is representative of the electrode support configurations of the other electrodes of gun 10. Electrode support tab 55 is preferably formed as an integral part of the material of electrode 32 as shown, and consists of a single thickness of the sheet metal from which the electrode is formed. At least one pair of these support tabs extend from each side of electrode 32. Referring now to FIG. 3, electrode support tab 55 has a distal end 62 and a stress-absorbing section 64, each having a specific function. The distal end 62 is fully embedded in the glass of structural bead 50, which is shown in section. The stress-absorbing section 64 is at most only partially embedded in bead 50, and acts to absorb stress that may be resident in both the bead 50 and electrode 32, with the result that the tendency toward bead cracking and electrode displacement is alleviated.

The stress absorption provided by section 64 of electrode support tab 55 is a function of the composition of the material of tab 55, its shape, and its dimensions. With regard to material composition, electrode 32 and its integral extending support tab 55 may, for example, be an austenitic grade of stainless steel designated as AISI type 305. The deflection characteristics of metal of this composition as used in this application is shown by the curve in FIG. 4. As charted on deflection-versus-load X-Y axes, the curve indicates the magnitude of the deflection under load through part 66 of the curve wherein the material is elastic, or spring-like. Point 68 on the curve indicates the yield point of the tab. Beyond yield point 68 on the curve (part 70), the material has been deflected beyond its elastic limit and takes a final set so that it no longer acts like a spring.

In the area designated by 66, the material acts like a spring and will return to its undeflected position when the load is removed. Under additional deflection, however, yield point 68 is reached after which the material may be deflected with little increase in load and no longer acts as a spring because of its over-stressed condition. As a result, little residual stress is transferred to the bead and electrode which the tab interconnects. The factor that determines the design configuration of the tab is the magnitude of the strain that results during the beading process. The shape and dimensions of stress-absorbing section 64 are configured so that the stress levels in the tabs associated with this strain at the time the gun is in the beading fixture lie just beyond yield point 68, or the elastic limit, of the load-deflection curve. Beyond yield point 68, the metal of the tab cannot recover because it has been over-stressed with the result that there is little "spring-back" of the electrode support structure to impart stress in any direction, whether angular or torsional. So the shape and dimensions of the electrode support tab represent a balanced design between a too-weak structure and a structure so stiff that it returns the beading strains like a spring. The objective is to have the tabs permanently set in a deformed but supportive attitude substantially free from any residual stress.

Figure 5:
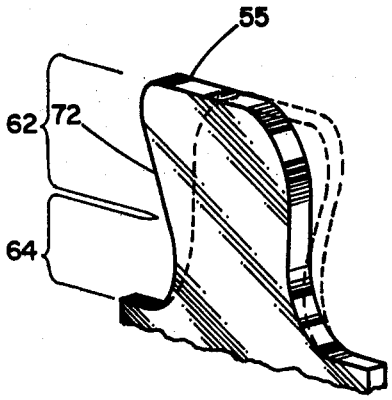
FIG. 5 shows the effect of angular deflection on a stress-absorbing neck section constructed according to this invention.
Figure 5A:
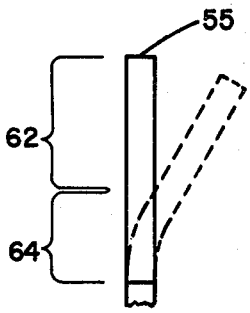
FIG. 5A is an end view of a tab configuration showing the effect of angular deflection of the tab.
Figure 6:
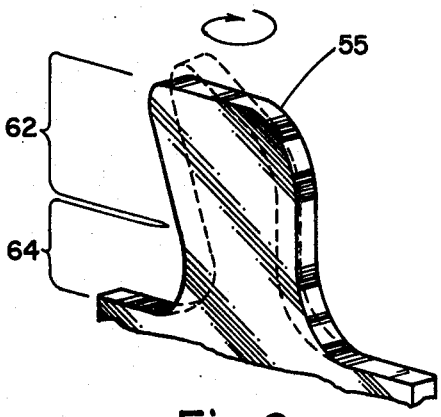
FIG. 6 shows the effect of torsional deflection on a stress-absorbing neck section of an electrode support tab constructed according to this invention.

A side view of the stress-absorbing angular deflection of a tab when deflected is shown by FIGS. 5 and 5A. (Angular deflection is defined as deflection of a planar tab out of its own plane.) FIG. 6 shows the effect of stress-absorbing torsional deflection of a tab of similar configuration. (Torsional deflection is deflection around the longitudinal axis of the tab.) Deflection may also be a combination of torsional and angular deflection in a tab. It should be noted that the amplitude of the angular and torsional deflection is exaggerated in the figures: the actual amplitude is in terms of tenths of a mil.

It is common in prior art non-unitized gun assemblies to form rigid mounting straps or arms to fit the shape of the electrode to be mounted, bonding these support members to the electrode by welding, and then embedding the claw-formed distal ends of the support members into heat-softened glass beads. This structure commonly results in an electrode having one support member on each side, with the two oppositely posed members lying in the same pivotal axis. This configuration provides the entire support for the electrode.

This structure has disadvantages, however, in that the single support member on each side of the electrode provides only an abbreviated baseline of support on either side so that the electrode may pivot, twist or otherwise displace under stress, with consequent degradation of gun performance. Also, as cited, the equivalent section 64 (referring to FIG. 3) which is the stress-absorbing section of the present invention, is commonly rigid and stiff in prior art structures and thus unable to absorb stress, and will transmit any stress to either or both of the structures to which it connects. The result is a significant tendency toward bead fracture because the stress will be locked in at the region of embedment of the rigid claw. Or, if the bead itself does not relieve the stress by fracturing, the stress will be exerted upon the electrode, causing it to displace.

Figure 9:
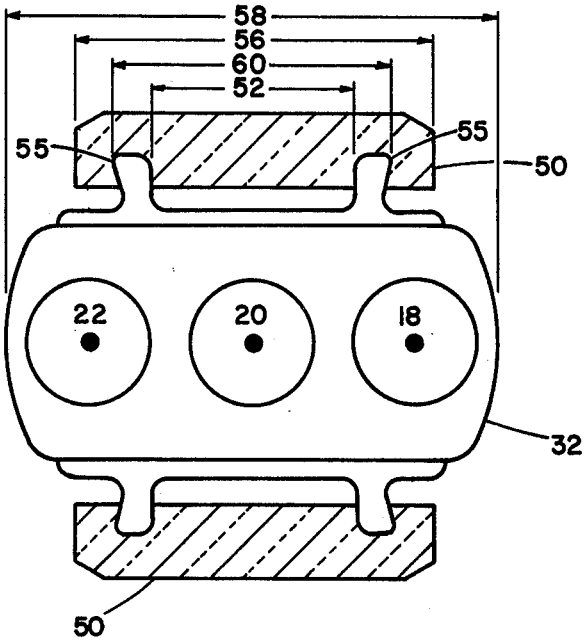
FIG. 9 is a sectional view taken along lines 9—9 of FIG. 2 in which the electrode support tab design of FIG. 3 is shown in relation to the structural beads.

It will be noted, however, that the stress-absorbing electrode support that is the subject of this invention would not be sturdy enough to lend itself to use in such prior art structures wherein a single support member is used on each side of the electrode. However, while less firm as a single entity, when used collectively as a pair with another of its type attached to the same side of the electrode and spaced widely from its opposite, the paired structural configuration offers greater stability and strength, in addition to other marked advantages over the prior art single support structure concept. These advantages are shown by FIG. 9, which is a sectional view taken along line 9-9 in FIG. 2. The pair of beads 50 have a wide stance base-line 56 which preferably spans at least one-half the maximum width 58 of electrode 32. One pair of electrode support tabs 55 is positioned on each side of electrode 32 with the result that electrode 32 has a total of four support tabs, two on each side. More than one pair of support tabs per side may be used, although only one pair per side is shown by FIG. 9.

Further with regard to FIG. 9, support tabs 55 of each pair are preferably relatively narrow and are spaced apart a span distance that is preferably equal to at least one-half the maximum width 58 of electrode 32. The wide spacing of each of the two pairs of support tabs which are preferably an integral part of electrode 32 makes possible the embedment of support tabs 55 in widely spaced regions in the glass beads 50, thereby enhancing the lateral stability of the electrodes and promoting the establishment and maintenance of proper parallelism, spacing and coaxial alignment of the electrodes. In conjunction, the widely spaced, relatively narrow electrode support tabs permit the creation of the central, axially extending, uniformly stressed, mechanically strong region 52 in each of the two glass beads 50 that structurally support electron gun 10. The widestance tabs and wide beads for electrode support do not constitute per se an aspect of this invention, but are described and claimed in copending application Ser. No. 642.049 filed Dec. 18, 1975.

This "doubling" of support of electrode 32 resulting from the use of one or more pairs of relatively narrow, widely spaced electrode support tabs 55 on each side thereof makes possible the application of the stress-absorbing electrode supports that are the subject of this invention, and the benefits gained therefrom. Stress-absorbing electrode support tabs, while individually less rigid and strong than their prior art single-support counterparts, collectively, as a pair, form an electrode support structure of adequate strength and greater stability.

Figure 7:
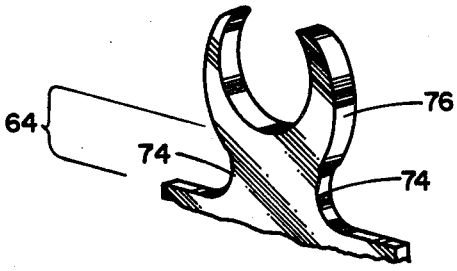
FIG. 7 shows an electrode support tab configuration having a bulbous head section incorporating a claw, and with a double-taper, stress-absorbing neck section.
Figure 8:
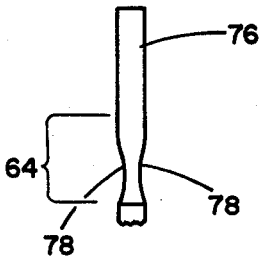
FIG. 8 is an end view of a tab whose material thickness in the stress-absorbing neck section is in the form of a double taper.

In an aspect of the preferred embodiment shown by FIG. 3, distal end 62 of tab 55 is a bulbous head 62 and section 64 is a necked-down stress-absorbing section. The stress-absorbing characteristics of section 64 can also be obtained by varying the shape and dimensions of section 64 as shown by FIGS. 7–8, which represent other embodiments of aspects of this invention. For example, the stress-absorbing characteristics of section 64 of FIGS. 5, 5A and 6 are attained by a single taper in area on only one side of electrode support tab 55. This single taper can be embodied on either side of the tab; that is, distal end 72 can face either to the right or to the left. With reference to FIG. 7, stress-absorbing section 64 can also consist of a double taper 74 in area, or "hour-glass" configuration of tab 76 as shown. In another aspect of this invention, the stress-absorbing characteristics of section 64 can also be attained by shaping and dimensioning section 64 as a single taper in material thickness, or, a double taper in material thickness. FIG. 8 shows an end view of an electrode support structure configured as a double taper, 78 in material thickness. Also, with regard to the distal end 62 of the support tab, the shape defined by this invention is not limited to an asymmetrically configured head, but may be of symmetrical shape such as rectangular, with claw, or a bulbous-shape with a single claw as shown by FIG. 7, or a double claw with cusp or tine.

The following exemplary specifications are cited for the electrode support tab configuration 55 shown by FIG. 3 that represents one aspect of the preferred embodiment of this invention. The electrode and its support tabs, which may be formed integrally from the electrode material, is fabricated, for example, from stainless steel AISI type 305 strip having a Rockwell hardness of B80 and an initial thickness of 0.010 inch (0.25 mm). The support tabs extend from the body of the electrode a distance of 0.060 inch (1.59 mm). The stress-absorbing section 64 of the single taper in area tab shown by FIG. 3 tapers from distal end 62 at a nominal 15° angle culminating in a minimal neck width of 0.050 inch (1.12 mm).

Other changes may be made in the above-described apparatus without departing from the true spirit and scope of the invention herein involved, and it is intended that the subject matter in the above depiction shall be interpreted as illustrative and not in a limiting sense.

We claim:

1. For use in a color television cathode ray tube, a unitized, in-line electron gun; that is, a gun generating three coplanar electron beams and having beam-forming and beam-shaping electrodes common to the three beams, said electrodes being supported as a coherent unit in spaced tandem succession along the gun's central axis by electrode support tabs extending from each electrode and embedded in two elongated, axially oriented solid structural beads positioned on opposite sides of the electrodes; that is, on opposite sides of the beam plane, at least one of said electrodes having on each side thereof at least one pair of widely spaced, relatively narrow tabs integrally formed with the electrode, and lying respectively in planes transverse to the gun axis, with said tabs embedded at widely spaced points on the glass bead to enhance the lateral stability of the electrodes, once embedded in the beads, to promote the establishment and maintenance of parallelism, precise spacing, and aperture concentricity of adjacent ones of said electrodes, said gun being characterized by each of said support tabs in said pair of tabs having a distal end and a stress-absorbing section, said distal end of each of said tabs being embedded in one of said structural beads, with said stress-absorbing section at most partially embedded in said structural bead, and with said stress-absorbing section being of such composition, shape and dimension as to deflect beyond its elastic limit during its embedment in said structural bead and to thereby yield and set permanently in a deformed but supportive attitude substantially free of any residual stress upon said electrode and said structural bead which would tend to fracture said bead or displace said electrode relative to said bead and thus to others of said electrodes.

2. The gun defined by claim 1 wherein said distal end includes a head section and wherein said stress-absorbing section comprises a neck of reduced cross-sectional area, and wherein said head is configured relative to said neck to promote said deflection of said neck beyond its elastic limit during its embedment thereof in said bead.

3. The gun defined by claim 1 wherein the shape of said distal end of said support tab is selected from a group of head configurations consisting of asymmetrical, bulbous and rectangular.

4. The gun defined by claim 3 wherein said asymmetrical head faces inwardly in a plane transverse to the longitudinal axis of the gun.

5. For use in a color television cathode ray tube, a unitized, in-line electron gun; that is, a gun generating three coplanar electron beams and having beam-forming and beam-shaping electrodes common to the three beams, said electrodes being supported as a coherent unit in spaced tandem succession along the gun's central axis by electrode support tabs extending from each electrode, and embedded in two elongated, axially oriented solid structural beads positioned on opposite sides of the electrodes; that is, on opposite sides of the beam plane, at least one of said electrodes having on each side thereof at least one pair of widely spaced, relatively narrow tabs integrally formed with the electrode, and lying respectively in planes transverse to the gun axis, with said tabs embedded at widely spaced points on the glass bead to enhance the lateral stability of the electrodes, once embedded in the beads, to promote the establishment and maintenance of parallelism, precise spacing, and aperture concentricity of adjacent ones of said electrodes, said gun being characterized by each of said tabs having at a distal end thereof a bulbous head section supported by a necked-down stress absorbing section, with said bulbous head section embedded in one of said structural beads and with said necked-down section at most partially embedded in said structural bead, said necked-down section being of such composition, shape and dimension as to deflect beyond its elastic limit during its embedment in said bead and to thereby yield and to set permanently in a deformed but supportive attitude substantially free of any residual stress upon said electrode and said structural bead which would tend to fracture said bead and displace said electrode relative to said bead and thus to others of said electrode.

6. The gun defined by claim 5 wherein said bulbous head section is further configured by having at least one claw in said bulbous head section.

* * * * *